US008839864B2

(12) United States Patent
Beynon

(10) Patent No.: US 8,839,864 B2
(45) Date of Patent: Sep. 23, 2014

(54) CASING CUTTER

(71) Applicant: Douglas T. Beynon, Spring, TX (US)

(72) Inventor: Douglas T. Beynon, Spring, TX (US)

( * ) Notice: Subject to any disclaimer, the term of this patent is extended or adjusted under 35 U.S.C. 154(b) by 0 days.

(21) Appl. No.: 13/694,208

(22) Filed: Nov. 7, 2012

(65) Prior Publication Data

US 2014/0124202 A1 May 8, 2014

(51) Int. Cl.
*E21B 29/00* (2006.01)

(52) U.S. Cl.
CPC ..... *E21B 29/005* (2013.01)
USPC ..... 166/297; 166/298; 166/55.7; 166/55.8

(58) Field of Classification Search
CPC ..... E21B 29/005; E21B 29/00
USPC ..... 166/55.8, 55.6, 297, 298, 376; 175/428, 175/295, 344, 406, 426, 266, 267, 286; 407/2, 116; 408/144
See application file for complete search history.

(56) References Cited

U.S. PATENT DOCUMENTS 2,353,284 A * 7/1944 Barrett ..... 166/55.8
2,735,485 A * 2/1956 Metcalf, Jr ..... 166/55.8
2,899,000 A * 8/1959 Medders et al. ..... 166/55.8
5,036,921 A * 8/1991 Pittard et al. ..... 166/298
5,265,675 A * 11/1993 Hearn et al. ..... 166/297
5,735,359 A * 4/1998 Lee et al. ..... 175/269
6,920,923 B1 * 7/2005 Pietrobelli et al. ..... 166/55.8
7,063,155 B2 6/2006 Ruttley
7,909,100 B2 3/2011 Bryant, Jr. et al.
8,555,955 B2 * 10/2013 Davis ..... 166/55.8
2012/0186817 A1 7/2012 Gibson et al.

OTHER PUBLICATIONS

*Type "CCH" Hydraulic Casing Cutter*, Pioneer Oil Tools Limited (2010).
*Hydraulic Casing Cutter*, Drillstar Industries.
*Extended Reach Hydraulic Pipe Cutter*, Servco (2011).
*Hydraulic Pipe Cutter*, Servco (2011).
*Statoil Saves 1.5 Days of Rig Time and USD 200,000 on North Sea Slot Recovery*, Schlumberger (2012).

* cited by examiner

*Primary Examiner* — Yong-Suk (Philip) Ro
(74) *Attorney, Agent, or Firm* — Keith B. Willhelm

(57) ABSTRACT

Tools and methods for cutting multiple, co-extending casings in oil and gas wells. The tools comprise a cylindrical body and first and second sets of cutting blades. Each set of cutting blades is mounted to the body for actuation from a retracted, run-in position to an extended, cutting position. The cylindrical body is rotated and the first set of cutting blades is actuated to cut the co-extending casings within a first sweep diameter. The second set of cutting blades then is actuated to cut the co-extending casings beyond the first sweep diameter and within a second sweep diameter.

25 Claims, 9 Drawing Sheets

CASING CUTTER

FIELD OF THE INVENTION

The present invention relates to tools used to cut casing in oil and gas wells, and more particularly, to cutting tools and methods for cutting multiple casings in oil and gas wells.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer, and thus, the porous layer forms a reservoir in which hydrocarbons are able to collect. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections referred to as a drill string. The drill string is suspended from a derrick and rotated by a motor in the derrick. A drilling fluid or "mud" is pumped down the drill string, through the bit, and into the well bore. This fluid serves to lubricate the bit and carry cuttings from the drilling process back to the surface. As the drilling progresses downward, the drill string is extended by adding more pipe sections.

When the drill bit has reached the desired depth, larger diameter pipes, or casings, are placed in the well and cemented in place to prevent the sides of the borehole from caving in. Once the casing is cemented in place, it is perforated at the level of the oil bearing formation so hydrocarbons can enter the cased well. If necessary, various completion processes are performed to enhance the ultimate flow of hydrocarbons from the formation. The drill string is withdrawn and replaced with production tubing. Valves and other production equipment are installed in the well so that the hydrocarbons may flow in a controlled manner from the formation, into the cased well bore, and through the production tube up to the surface for storage or transport.

That simplified example of an oil and gas well, comprising as it does a single casing and a single tube, is not often encountered in the real world. Given the depth of most producing oil and gas wells and various environmental considerations, they more commonly incorporate a number of pipes or "tubulars" of varying diameters. Casings of diminishing diameter may be "telescoped" together to extend the depth of the well. Multiple casings also may be nested in each other. For example, the upper portion, that is the wellhead or "tree" of a subsea well usually will comprise a number of nested, or coextending tubulars.

Very typically, a subsea tree will include a very large casing, what is called a conductor, with a diameter of 30 or more inches which is cemented in the well. A somewhat smaller diameter, but typically longer "surface" casing is nested in the conductor and cemented in place. The tree may include a smaller "intermediate" casing, but usually will include an even smaller "production" casing, which extends beyond its surrounding casings down to a hydrocarbon bearing formation. Finally, production tubing will be suspended inside the production casing.

While such complex well designs allow hydrocarbons to be produced safely and efficiently from even very deep subsea wells, they present significant challenges in "plug and abandonment, so-called "P&A" jobs. That is, eventually a well may be depleted to the point where further production is no longer economical. At that point, the well must be decommissioned by, inter alia, cutting the subsea tree at a minimum depth of a least 20 feet and then plugging the well.

Without minimizing the complexity of the overall P&A job, cutting the tree can present significant challenges. Production tubing, since it typically is suspended inside production casing, may be removed relatively easily by pulling it from the well. The various casings nested inside each other, however, usually are cemented in whole or in part and cannot be pulled. They must be cut in the well. The task is further complicated by the fact that the various casings often are not situated concentrically to each other, but often are displaced relative to the conductor axis and are eccentrically nested.

Most commonly, and certainly most preferably, the casing is cut from the inside out by attaching a cutting tool to the end of a work string and running it down into the casing. Typically such tools incorporate a set of three identical blades, although smaller diameter tools may incorporate only two blades. The blades are pivotally mounted to the body of the tool in a common plane, and are disposed symmetrically about the tool's primary axis. When the tool is being run into the casing the blades are in a closed or retracted position nesting in the body of the tool. Once at the desired depth, the tool is rotated via the work string. The blades are actuated and pivot outward, cutting the casing in the process.

Examples of such cutting tools include those disclosed in U.S. Pat. No. 7,909,100 to C. Bryant, Jr. et al. and U.S. Pat. No. 7,063,155 to D. Ruttley. Other examples include cutting tools commercially available from Pioneer Oil Tools Limited (Scotland), Drillstar Industries (France), and the Servco division of Schlumberger Limited (France), such as those disclosed in the following marketing materials: Type "CCH" Hydraulic Casing Cutter, Pioneer Oil Tools Limited (2010); Hydraulic Casing Cutter, Drillstar Industries; Extended Reach Hydraulic Pipe Cutter, Servco (2011); and Hydraulic Pipe Cutter, Servco (2011). Those cutting tools incorporate various mechanisms for actuating the cutting blades and for determining when the blades have been fully extended and the full extent of their cut diameter has been reached. They also may be provided with blades of different lengths to provide the tool with a greater or lesser cut diameter. They all, however, incorporate a single set of pivoting cutting blades, all of the same length.

If the wellhead includes a number of casings, such as the tree of a deep subsea well, the process of cutting all the casings and pulling them from the well often must proceed in stages. That is, a first cutting tool having a relatively smaller cutting diameter is lowered into the innermost casing. The casing is cut, the tool is retrieved, and the cut casing then is pulled from the well. Another cutting tool, having a larger cut diameter, then is run into the remaining casing and the process repeated. If necessary, the process is repeated with yet another cutting tool having an even larger cut diameter until all casing in the well has been cut and pulled.

Multiple cutting trips most commonly are required in shutting down deep, subsea well, but ironically, those are the situations where multiple trips are the most costly. Apart from capital expenses for equipment, operating costs for modern offshore rigs can be $500,000 or more a day. Ever increasing operational costs of drilling rigs makes it increasingly important to combine operations so as to reduce the number of trips into and out of a well and to reduce the time spent by a rig on site.

Accordingly, there remains a need for new and improved systems, apparatus and methods for cutting casings in oil and gas wells. Such disadvantages and others inherent in the prior art are addressed by various aspects and embodiments of the subject invention.

SUMMARY OF THE INVENTION

The subject invention encompasses various embodiments and aspects, some of which are specifically described and illustrated herein, and other which are apparent from those embodiments specifically addressed. Such embodiments generally include tools and methods used to cut casing in oil and gas wells, and more particularly, to cutting tools and methods for cutting multiple casings in oil and gas wells.

For example, one aspect of the invention provides for a tool for cutting casings in oil and gas wells which comprises a cylindrical body and first and second sets of cutting blades. The cylindrical body is adapted for connection to a work string and for insertion into a casing mounted in a well. The first set of cutting blades is mounted to the body. They are radially offset from each other about the body and are adapted to extend radially from the body. The extension of the first cutting blades defines a first sweep diameter. A second set of cutting blades is mounted to the body. The second cutting blades are radially offset from each other about the body and are adapted to extend radially from the body. The extension of the second cutting blades defines a second sweep diameter.

Other embodiments and aspects of the subject invention provide methods of cutting casings in oil and gas wells having a plurality of co-extending casings. The novel methods include inserting a cutting tool into the innermost of the co-extending casings. The cutting tool comprises a cylindrical body, a first set of cutting blades and a second set of cutting blades. The first set of cutting blades is mounted to the body for actuation from a retracted, run-in position to an extended, cutting position. The first cutting blades define a first sweep diameter in the extended, cutting position. The second set of cutting blades is also mounted to the body for actuation from a retracted, run-in position to an extended, cutting position. The second cutting blades define a second sweep diameter in the extended, cutting position. Preferably, the second sweep diameter is greater than the first sweep diameter. The cylindrical body then is rotated and the first set of cutting blades is actuated to cut the co-extending casings within the first sweep diameter. The second set of cutting blades then is actuated to cut the co-extending casings beyond the first sweep diameter and within the second sweep diameter.

The subject invention in other aspects and embodiments provides tools and methods where the second sweep diameter is greater than the first sweep diameter, where the first set of cutting blades and the second set of cutting blades are axially displaced from each other, or where the first set of cutting blades and the second set of cutting blades are radially displaced from each other.

Yet other embodiments provide tools where the first cutting blades are mounted for actuation from a retracted, run-in position to an extended, cutting position and the second set of cutting blades are mounted for actuation from a retracted, run-in position to an extended, cutting position after actuation of the first set of cutting blades.

Still other embodiments and aspects of the subject invention encompass tools and methods where the cutting blades are pivotally mounted in slots defined in the body or where the cutting tool comprises a hydraulic actuator mounted in a cylindrical passageway defined by the body and which is adapted to extend the first and second sets of cutting blades.

Various aspects and embodiments of the invention also provide for tools and methods where the hydraulic actuator comprises an upper piston and a lower piston mounted in the cylinder defined by the body. The upper piston has a cylindrical skirt and an upper portion of the lower piston is nested in the skirt. Other embodiments provide tools and methods where the upper and lower pistons each have a conduit therein adapted to allow fluids introduced into the tool to flow through the actuator. The actuator comprises a port adapted to allow fluids introduced into the actuator to flow out of the conduit when the lower piston has traveled downward in the skirt of the upper piston.

In various other aspects, the subject invention provides for tools and methods where the cutting blades are mounted to the body at their proximate end. The proximate ends of the cutting blades have gear teeth provided thereon. The hydraulic actuator comprises a first part and a second part. The first part has a rack gear provided thereon which engages the gear teeth of the first cutting blades and the second part has a rack gear provided thereon which engages the gear teeth of the second cutting blades.

Other aspects and embodiments of the invention provide for tools and methods where the hydraulic actuator comprises a piston mounted in the cylinder defined by the body. Travel of the piston in the cylinder is adapted to extend the first set of cutting blades from a retracted, run-in position to an extended, cutting position. The piston has a conduit therein adapted to allow fluids introduced into the tool to flow through the piston and a port communicating with the conduit. The port is adapted to allow fluid to flow from the conduit of the piston out of the tool after the piston has fully extended the first set of cutting blades.

Still other embodiments and aspects provide tools and methods where the hydraulic actuator comprises an upper piston and a lower piston mounted in the cylinder defined by the body. The upper and lower pistons releasably engage each other and each has a conduit therein adapted to allow fluids introduced into the tool to flow through the actuator. The upper and lower pistons are adapted for disengagement after the first set of cutting blades has been fully extended, and the disengagement allows fluid to flow from the conduit of the upper piston out of the tool.

The subject invention in various other embodiments also, provides for tools and methods where the hydraulic actuator comprises a piston mounted in the cylinder defined by the body. Travel of the piston in the cylinder is adapted to extend the second set of cutting blades from a retracted, run-in position to an extended, cutting position. The cylinder has a port therein and the port is adapted to allow fluid introduced into the cylinder to flow out of the tool after the piston has fully extended the second set of cutting blades.

Thus, the present invention in its various aspects and embodiments comprises a combination of features and characteristics that are directed to overcoming various shortcomings of the prior art. The various features and characteristics summarized above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1A:
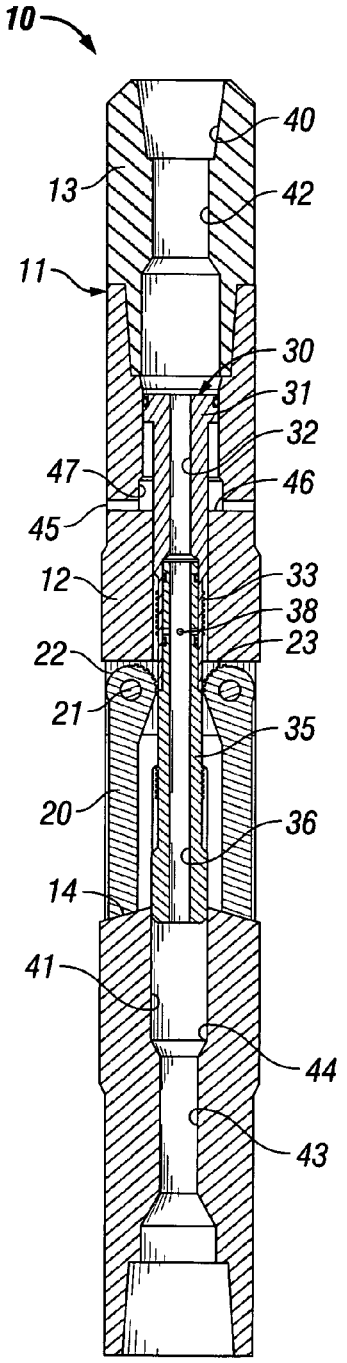
FIG. 1A is a cross-sectional view of a preferred embodiment 10 of the casing cutters of the subject invention showing casing cutter 10 in its run-in position.

In the drawings and description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The casing cutters of the subject invention, such as the preferred embodiment 10 illustrated in FIGS. 1-5, are intended primarily to cut casings in oil and gas wells, especially a plurality of nested casings. They comprise a cylindrical body which is adapted for connection to a work string and for insertion into a casing mounted in a well. A first set of cutting blades is mounted to the body. The cutting blades are radially offset from each other about the body and are adapted to extend radially from the body, thereby defining a first sweep diameter. A second set of cutting blades is also mounted to the body. The second set of cutting blades are radially offset from each other about the body and are adapted to extend radially from the body, thereby defining a second sweep diameter.

The tool body of the novel casing cutters is adapted to provide an up-tool connection to a work string and a down-tool connection to any other work string tools or components that may be required. It also provides a base onto which are mounted the various other tool components. For example, preferred casing cutter 10 comprises in general a tool body 11 to which are mounted two sets of cutting blades 20 and 25, a longer, upper set of blades 20, and a shorter, lower set of blades 25. As will be described in greater detail below, blades 20 and 25 are run into a well in their retracted position and once in the well are extended to a cutting position by an actuator 30. Actuator 30 operates to first extend the lower set of cutting blades 25, then to allow retraction of the lower blades 25 and to extend the upper set of cutting blades 20, and finally to allow retraction of upper cutting blades 20.

More specifically, tool body 11 of casing cutter 10 comprises generally cylindrical main body or sub assembly 12. A top sub assembly 13 is threaded at its lower end to main sub 12. Top sub 13 allows casing cutter 10 to be assembled more easily, and its upper end is threaded so that cutter 10 may be threaded to a work string (not shown). A suitable sub assembly, such as a bull nose nozzle for dispersing cuttings away from the casing cutter (not shown), may be threaded onto its lower end. Alternately, other tools may be threaded thereto, such as a suitable non-rotating stabilizer. Such stabilizers can help to improve the cutting efficiency of the casing cutter.

Tool body 11 has a central passageway 40 that extends through tool body 11 along its primary axis. When assembled into a work string, passageway 40 is in fluid communication with the work string and any sub assembly or tool connected to the lower end of casing cutter 10 and allows hydraulic fluid to be pumped through casing cutter 10. It is generally cylindrically shaped. Different portions of passageway 40, however, have different diameters primarily to allow travel of actuator and control of hydraulic fluid being pumped through casing cutter 10 during operation. Passageway 40 also allows circulation to be established in the well to lubricate the cutting surfaces of the blades and carry cuttings away from the cut area, in much the same way that circulation is established in drilling a well. Thus, the length and diameter of the various portions of the central passageway may be varied considerably consistent with such purposes and the design and operation of the casing cutter as described below.

More specifically, the mid-portion of central passageway 40, which extends from the lower part of top sub 13 through the upper portion of main sub 12, defines a cylinder 41 in which actuator 30 may travel. The upper travel of actuator 30 is limited by restriction 42 in top sub 13. The lower travel of actuator 30 is limited by restriction 43 in main sub 12, which forms what may be considered a tub 44 in the lower portion of cylinder 41.

The blades of the novel casing cutters are adapted to project radially from the tool body in their cutting position, the extension thereof defining a sweep or cut diameter. For example, blades 20 and 25 of casing cutter 10 shown in FIGS. 1-5 are elongated members having cutting surfaces on their distal ends. It will be appreciated that the general configuration of the blades and especially their cutting tip may be varied considerably depending on the amount of force that will be transmitted to the cutting surfaces, the desired cut characteristics, and the material that may be cut. Typically, the tip will be dressed with tungsten coatings, or provided with inserts that enhance the cutting ability of the blades.

The cutting blades also are adapted to extend radially from a retracted, run-in position to an extended, cutting position. For example, blades 20 and 25 are pivotally mounted to main sub 12 by, for example, removable pins 21 and 26, respectively. Blade pins 21 and 26 extend through suitable holes in the enlarged, proximal ends 22 and 27 of, respectively, blades 20 and 25. Proximal ends 22 and 27 of blades 20 and 25 are provided with, respectively, gear teeth 23 and 28 across a semi-cylindrical surface thereof to provide engagement with actuator 30 which, as described in further detail below, will cause blades 20 and 25 to pivot outward into a cutting position.

Figure 2A:
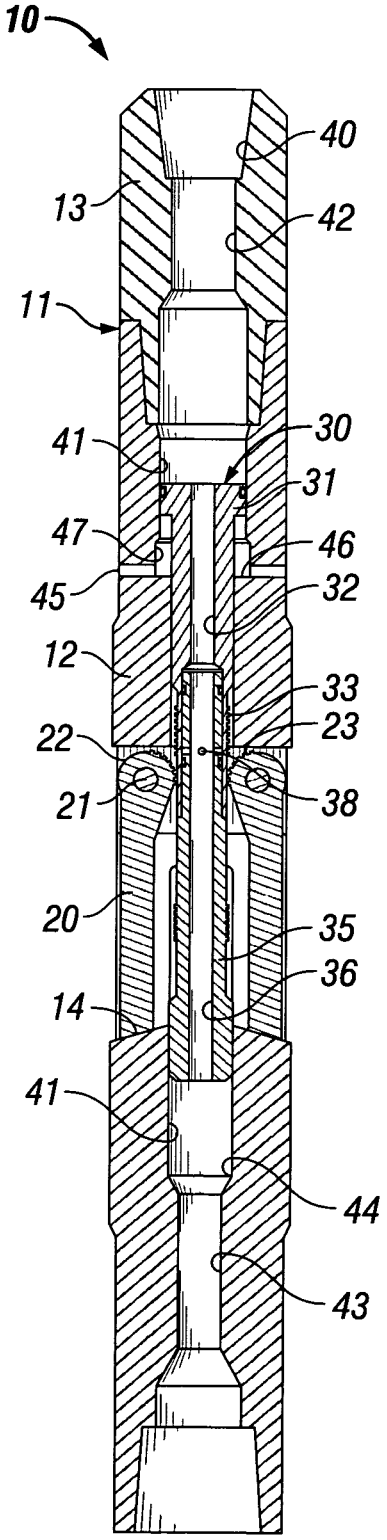
FIGS. 2A and 2B are cross-sectional views of casing cutter 10, taken from perpendicular viewing planes as in, respectively, FIGS. 1A and 1B, wherein casing cutter 10 is shown with a lower set of cutting blades 25 extended in a cutting position.
Figure 2B:
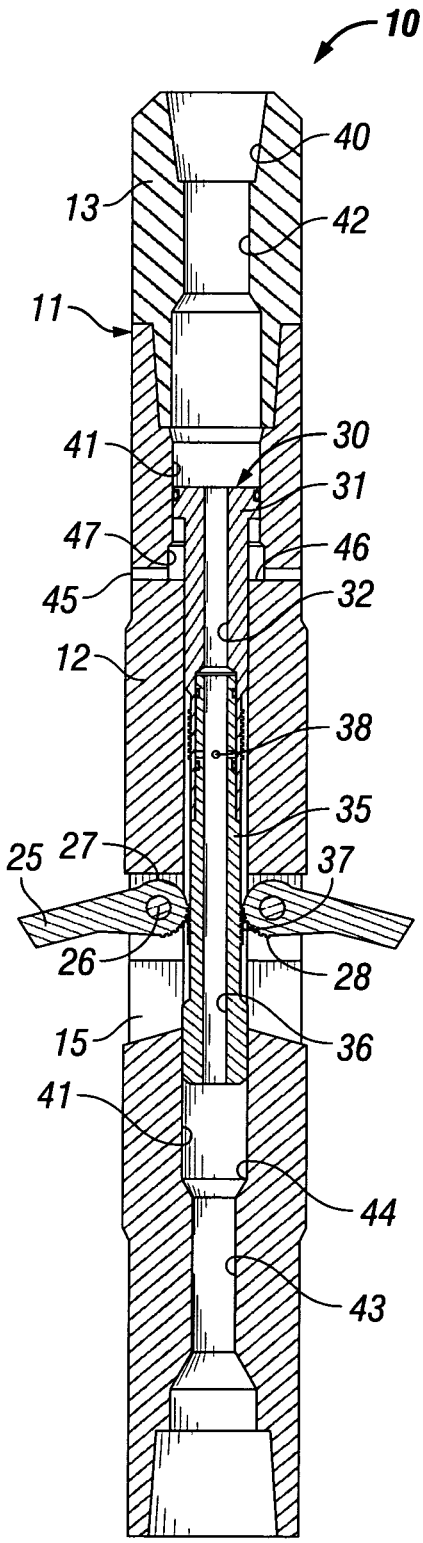
Figure 3A:
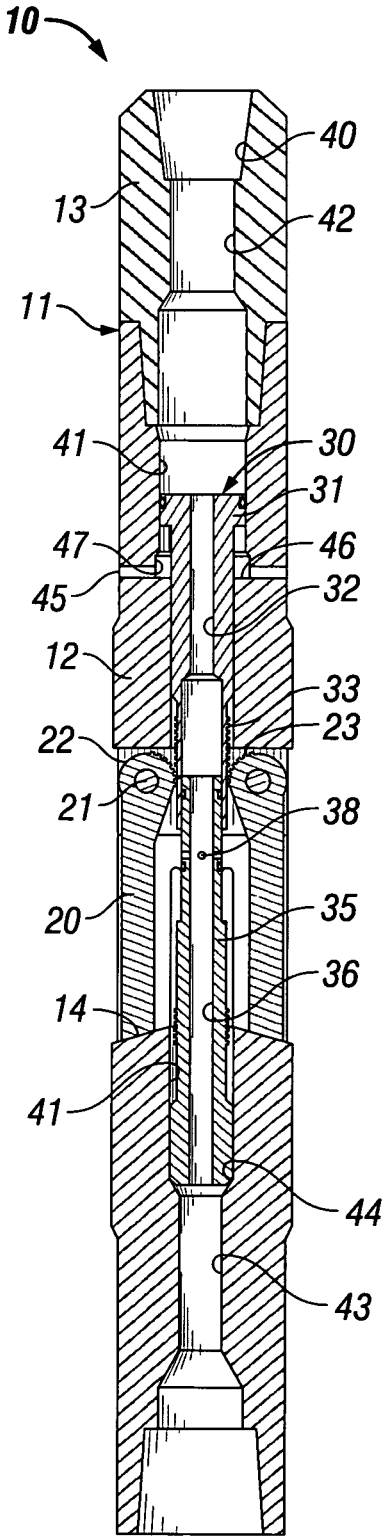
FIGS. 3A and 3B are perpendicular cross-sectional views of casing cutter 10 taken as in FIGS. 1-2, wherein casing cutter 10 is shown after retraction of lower cutting blades 25.

The cutting blades also preferably may be fully retracted into the profile of the novel cutters so that the cutter may be run into smaller casings and reducing the likelihood that it will hand up as it is being run into a well. Thus, for example, blades 20 and 25 are mounted, respectively, in windows 14 and 15 provided in main sub 12. Windows 14 and 15 preferably fairly closely accommodate blades 20 and 25 when they are in their retracted position, as shown in FIGS. 1, 3, and 5, and preferably allow them to retract fully within the profile of casing cutter 10. Windows 14 are somewhat longer than windows 15 to accommodate longer upper blades 20. The lower ends of windows 14 and 15 also preferably are tapered to provide a stop and support for the lower ends of blades 20 and 25, thereby minimizing possible damage to blades 20 and 25 as cutter 10 is run into a well. Blades 20 and 25 are able to pivot radially outward from positions more or less parallel to the primary axis of tool body 11 and extend from main sub 12 when actuated, as shown in FIGS. 2 and 4.

It will be appreciated that preferably the blades in each set of blades are radially offset, and symmetrically so, about the primary axis of the casing cutter. For example, as will be appreciated from FIGS. 1-5, cutter 10 has two blades in each of the upper and lower set of blades 20 and 25. The blades in each set 20 and 25 are mounted on opposite sides of cutter 10, that is, they are radially offset from each other by 180° apart. Depending on the overall diameter of the cutter, however, each set of blades may include more blades, for example, three blades spaced 120° apart. By disposing blades symmetrically about the primary axis the cutter is better balanced and is able to provide a smoother more reliable cut.

The first and second sets of blades also are preferably offset and displaced from each other radially, axially, or both. For example, blades 20 and blades 25 are offset radially from each other by 90°, and are offset axially along the primary axis, blades 20 being mounted above blades 25.

The actuator of the subject invention preferably, as in certain embodiments thereof, is adapted to sequentially actuate the first and second sets of blades. Hydraulic or mechanical actuators may be provided for such purposes. For example, actuator 30 of cutter 10 is a hydraulic actuator that first actuates the lower, shorter set of blades 25 and then actuates the upper, longer set of blades 20. More particularly, actuator 30 includes an upper piston 31 and a lower piston 31. Pistons 31 and 35 are nested together at their adjoining ends and are slidably disposed in cylinder 41. They each have, respectively, a central, cylindrically shaped conduit 32 and 36 that communicate with each other and allow fluid to pass through actuator 30. As described in further detail below, pistons 31 and 35 are hydraulically actuated in a controlled manner by fluid pumped into passageway 40.

The upper portion of upper piston 31 is generally cylindrical and somewhat enlarged at its upper extremity where it is hydraulically sealed by suitable O-rings or other sealing members within cylinder 41. A mid portion of upper piston 31 is provided with generally flat surfaces on opposing sides which are provided with gear teeth, thereby providing rack gears 33 on upper piston 31 which engage gear teeth 23 on enlarged proximal ends 22 of upper blades 20.

Lower piston 35 has a similar construction. Its lower portion is generally cylindrical and it has flats on opposing sides of a mid portion. Flats on lower piston 35 also are provided with gear teeth to provide rack gears 37 on lower piston 35 which engage gear teeth 28 on enlarged proximal ends 27 of lower blades 25. Thus, downward movement of pistons 31 and 35 will, as described in more detail below, cause blades 20 and 25, respectively, to pivot out of windows 14 and 15 into their cutting positions.

Figure 1B:
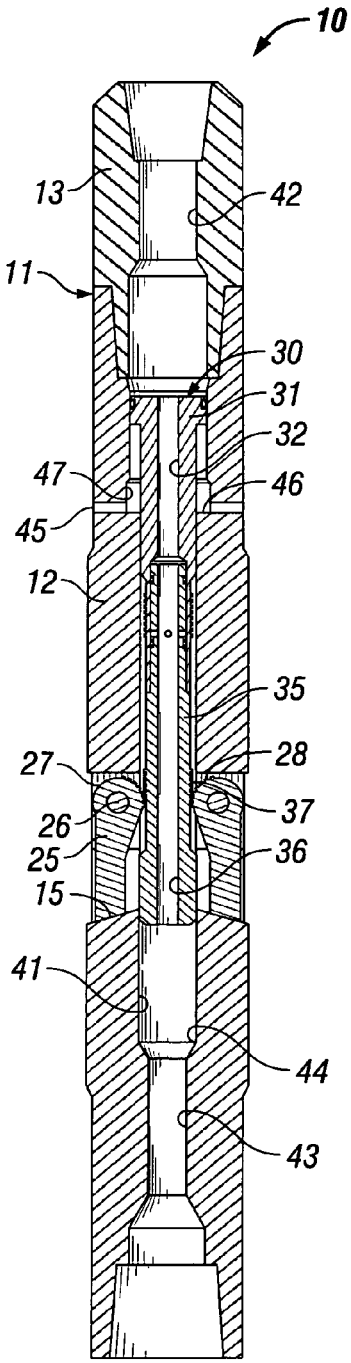
FIG. 1B is a cross-sectional view of casing cutter 10 shown in FIG. 1A, the cross-sectional view being taken along the plane perpendicular to the cross-section of FIG. 1A.

More specifically, when cutter 10 is in its run-in position as shown in FIG. 1, both longer, upper blades 20 and shorter, lower blades 25 are in their retracted positions. Actuator 30 is positioned in the upper portion of cylinder 41, with upper piston 31 being nested over and engaged with lower piston 35. The weight of cutting blades 25 will tend to hold actuator 30 in place. That is, as may be seen in FIG. 1B, lower blades 25 engage rack gears 37 on lower piston 35, the weight thereof resisting downward movement of actuator 30. Preferably, however, actuator 30 is releasably fixed in position, for example by shear pins or other shearable members (not shown).

Once cutter 10 is lowered to the desired depth, cutting operations are begun by rotating the work string and pumping hydraulic fluid through the work string. As fluid flows into passageway 41 of tool body 11, conduits 32 and 36 in pistons 31 and 35 being of smaller diameter than cylinder 41, hydraulic pressure is created above upper piston 31 causing it and lower piston 35 to travel downward. Since their gear teeth 23 have not yet engaged rack gears 33 on upper piston 31, as may be seen in FIG. 1A, the initial downward travel of upper piston 31 does not actuate upper blades 20. Downward travel of lower piston 35, however, causes lower blades 25 to extend radially and begin cutting the innermost casing. Fluid is continually pumped through cutter 10 to maintain hydraulic pressure on actuator 30. As will be appreciated from FIG. 2A, which shows lower blades 25 nearing full extension, lower piston 35 will continue to actuate and transmit force to lower blades 25, allowing them to mill away whatever casing is present until they are fully extended. Upper blades 20, as may be appreciated from FIG. 2A, remain in their retracted, run-in position as lower blades 25 are cutting.

Figure 3B:
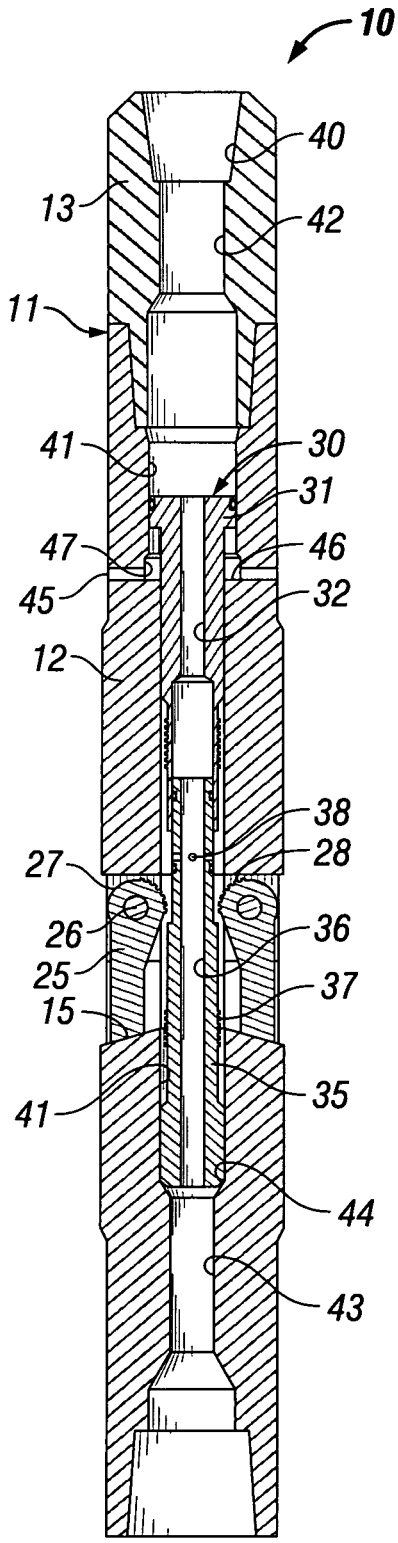

Once lower blades 25 are fully extended, further downward travel of pistons 31 and 35 will cause rack gears 37 on lower piston 35 to travel past gear teeth 28 on lower blades 25 and out of engagement therewith. At that point, lower piston 35 is free to drop away from upper piston 31 into tub 44, as best seen in FIG. 3B, which in turn allows lower blades 25 to retract back into windows 15.

The novel casing cutters preferably provide some indication of when the lower blades have been fully extended. For example, as best seen in FIGS. 3C and 3D, the lower portion of upper piston 31 has an open cylinder therein, or what may alternatively be viewed as a cylindrical skirt 34. The upper portion of lower piston 35 is able to nest and travel in cylindrical skirt 34. Upper portion of lower piston 34 also is provided with ports 38 which are situated between hydraulic sealing members, such as O-rings. When cutter 10 is run into a well, lower piston 35 is fully nested in skirt 34 of upper piston 31, as shown in FIG. 1, and ports 38 are sealed off. When lower blades 25 have been fully extended and lower piston 35 has dropped into tub 44, however, ports 38 in lower piston 35 will drop below and out of skirt 34 in upper piston 31 as may be seen in FIGS. 3C and 3D. Fluid being pumped into cutter 10 then is able to flow from conduit 36 of lower piston 35 out windows 14 and 15 instead of flowing through conduit 36. That flow will cause a pressure drop in fluid being pumped into the work string which in turn may serve as an indicator to operators on the surface that lower blades 25 have been fully extended and have completed cutting of any casing within their cutting diameter.

It will be appreciated that other means may be provided for creating a pressure drop when lower piston 35 drops away from upper piston 31. Ports may be provided in skirt 34 of upper piston 31 such that they would be uncovered by dropping of lower piston 35. Similarly, ports may be provided in both skirt 34 of upper piston 31 and in lower piston 35 such that they align when lower piston 35 drops. Other channels may be devised as well.

Once lower piston 35 has dropped into tub 44 and out of engagement with lower blades 25, further pumping of fluid and downward travel of upper piston 31 will cause its rack gears 33 to engage gear teeth 23 on upper blades 20. Once gear teeth 33 are engaged, further downward travel of upper piston 31 causes upper blades 20 to extend radially and begin cutting outer casing. It also will be appreciated that as upper piston 31 commences downward travel, skirt 34 will once again cover ports 38, causing a detectable increase in hydraulic pressure corresponding to actuation of upper blades 20.

Figure 4A:
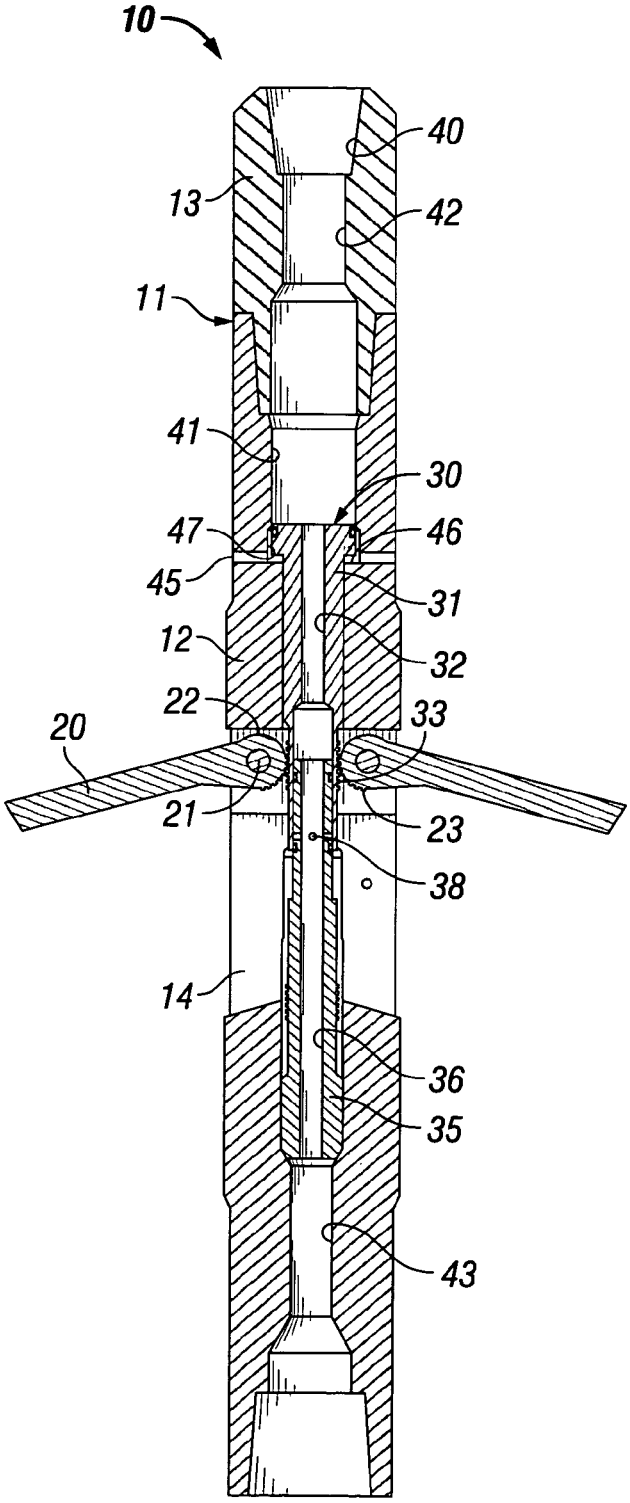
FIGS. 4A and 4B are perpendicular cross-sectional views of casing cutter 10 taken as in FIGS. 1-3, wherein casing cutter 10 is shown with an upper set of cutting blades 20 extended in a cutting position.
Figure 4B:
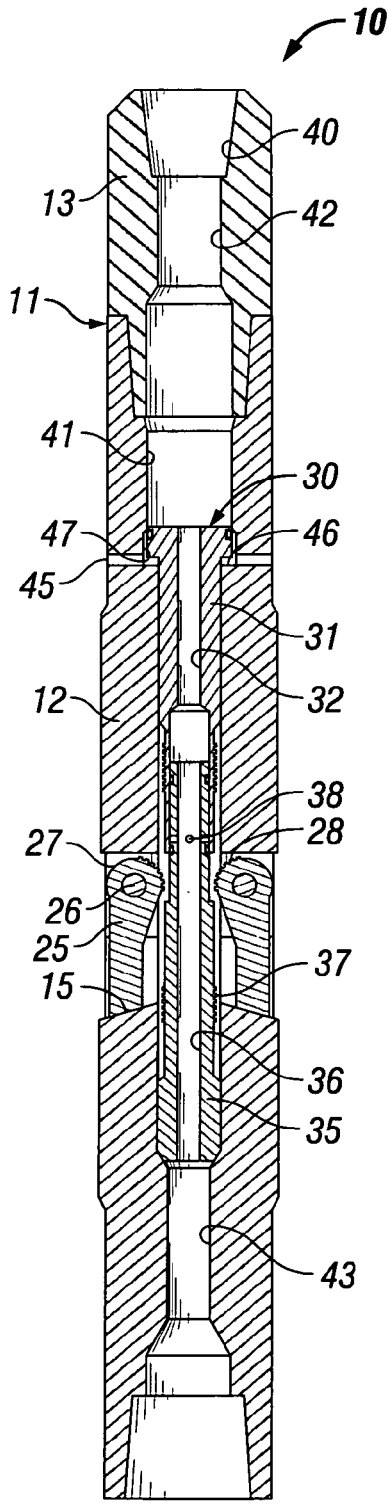
Figure 5A:
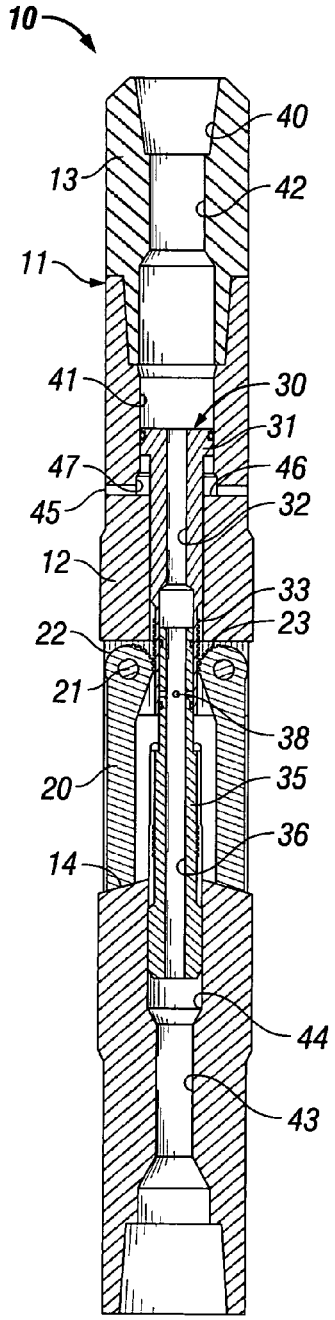
FIGS. 5A and 5B are perpendicular cross-sectional views of casing cutter 10 taken as in FIGS. 1-4, wherein casing cutter 10 is shown in its run-out position.
Figure 5B:
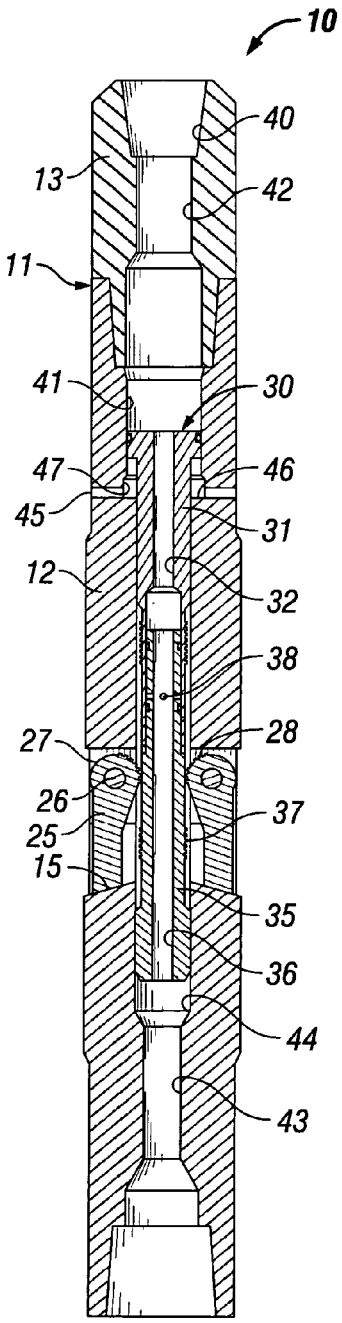
Figure 6A:
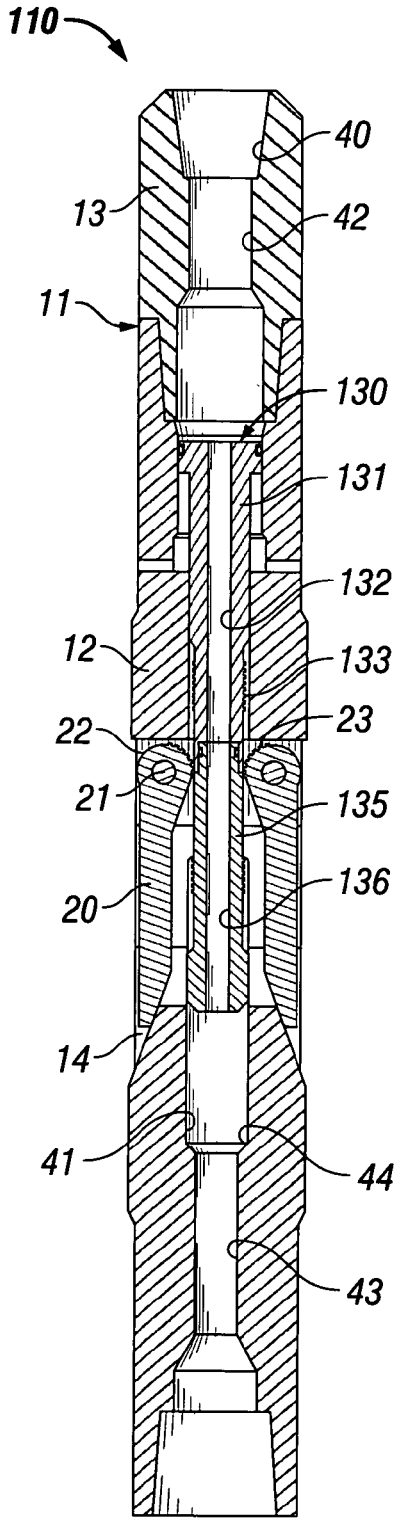
FIG. 6A is a cross-sectional view of a second preferred embodiment 110 of the casing cutters of the subject invention showing casing cutter 110 in its run-in position.
Figure 6B:
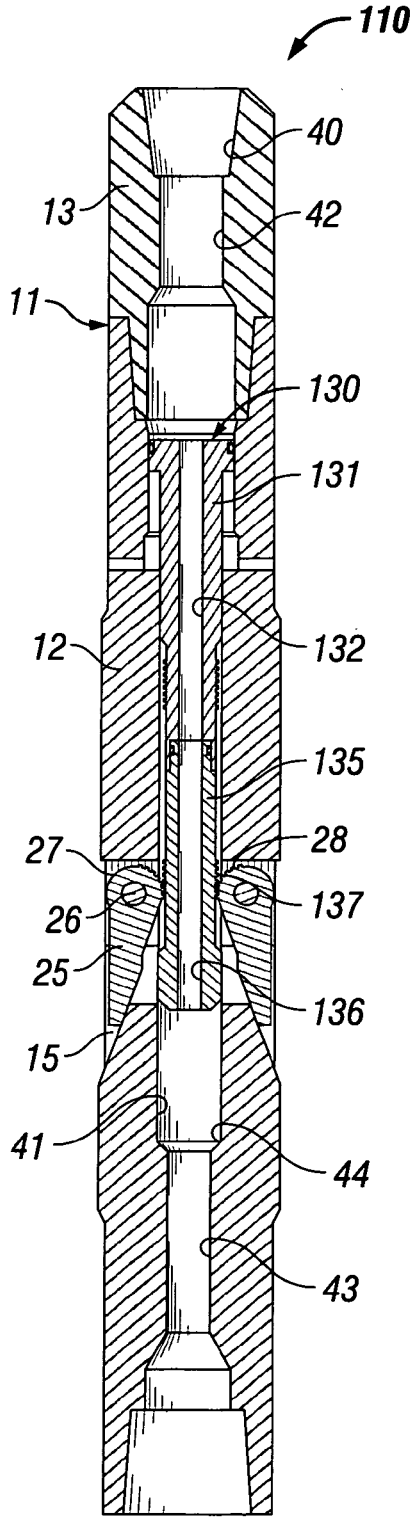
FIG. 6B is a cross-sectional view of casing cutter 110 shown in FIG. 6A, the cross-sectional view being taken along the plane perpendicular to the cross-section of FIG. 6A.
Figure 7A:
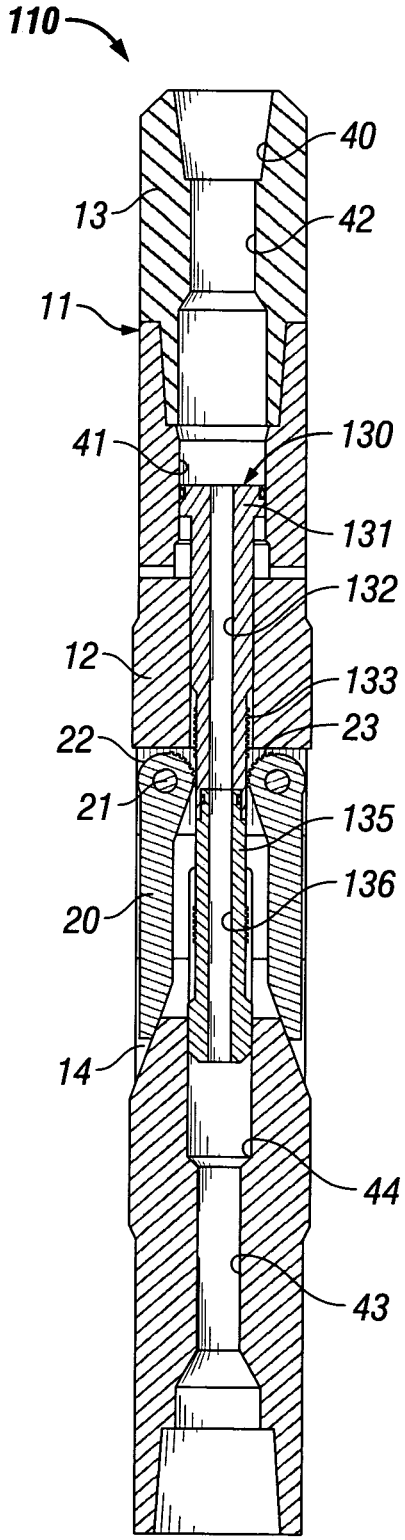
FIGS. 7A and 7B are cross-sectional views of casing cutter 110, taken from perpendicular viewing planes as in, respectively, FIGS. 6A and 6B, wherein casing cutter 110 is shown with a lower set of cutting blades 25 extended in a cutting position.
Figure 7B:
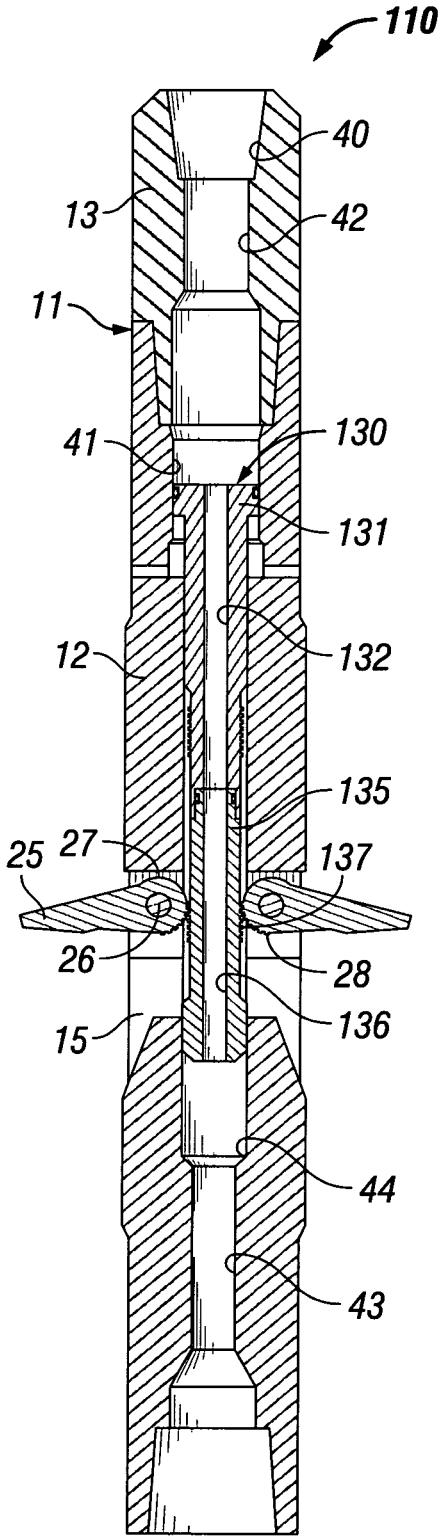
Figure 8A:
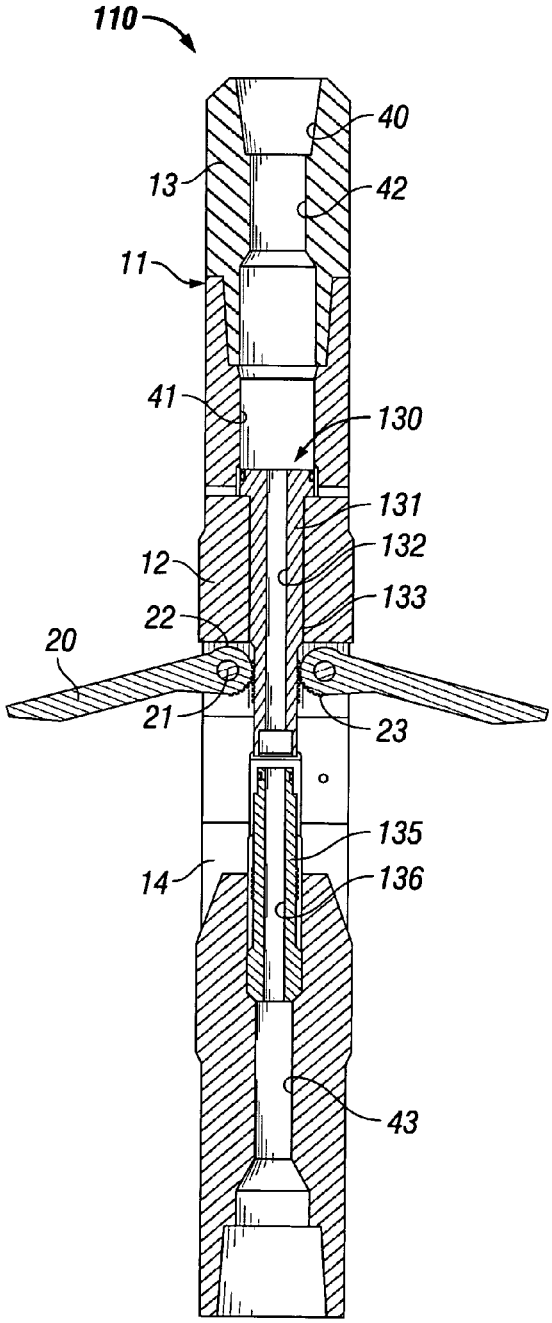
FIGS. 8A and 8B are perpendicular cross-sectional views of casing cutter 110 taken as in FIGS. 6-7, wherein casing cutter 110 is shown with an upper set of cutting blades 20 extended in a cutting position.
Figure 8B:
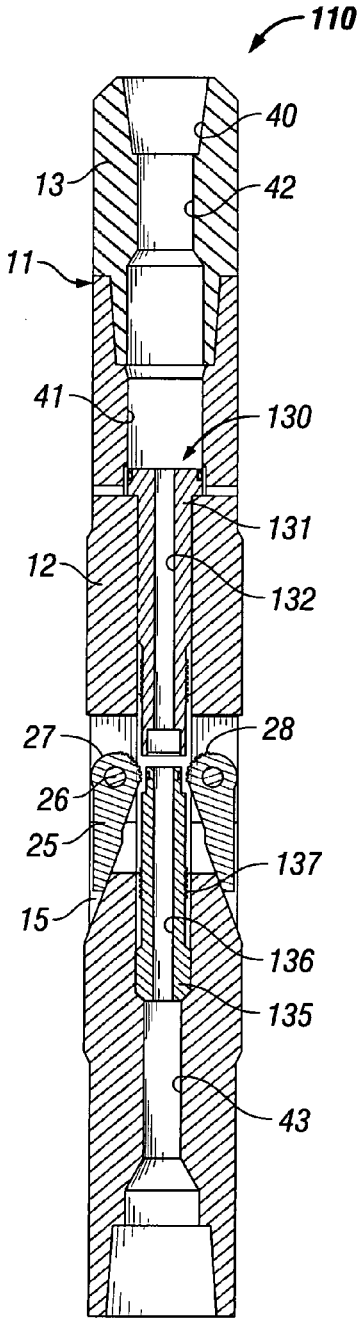
Figure 9A:
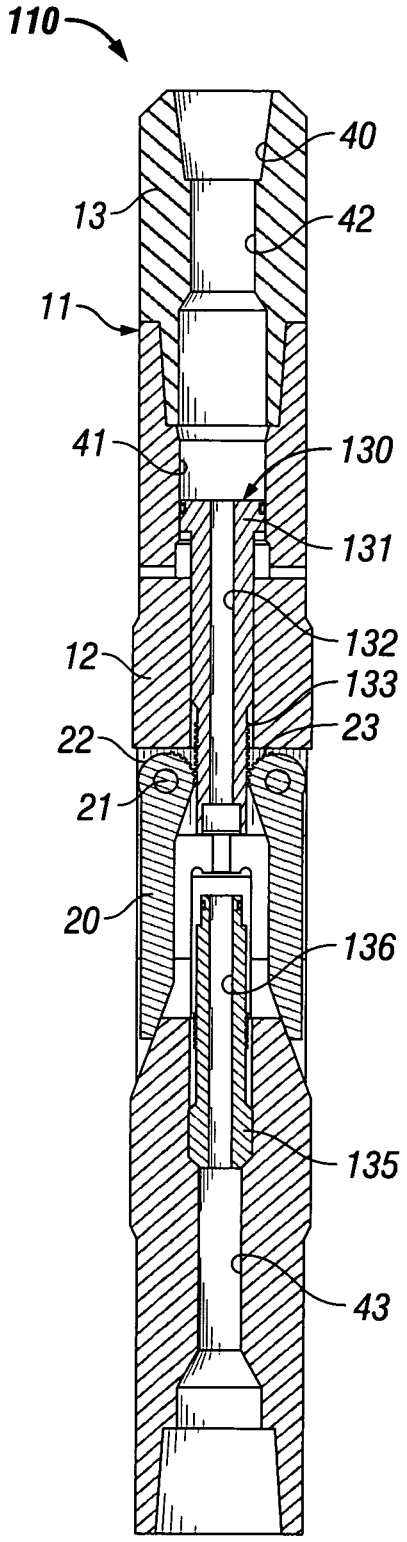
FIGS. 9A and 9B are perpendicular cross-sectional views of casing cutter 110 taken as in FIGS. 6-8, wherein casing cutter 110 is shown in its run-out position.
Figure 9B:
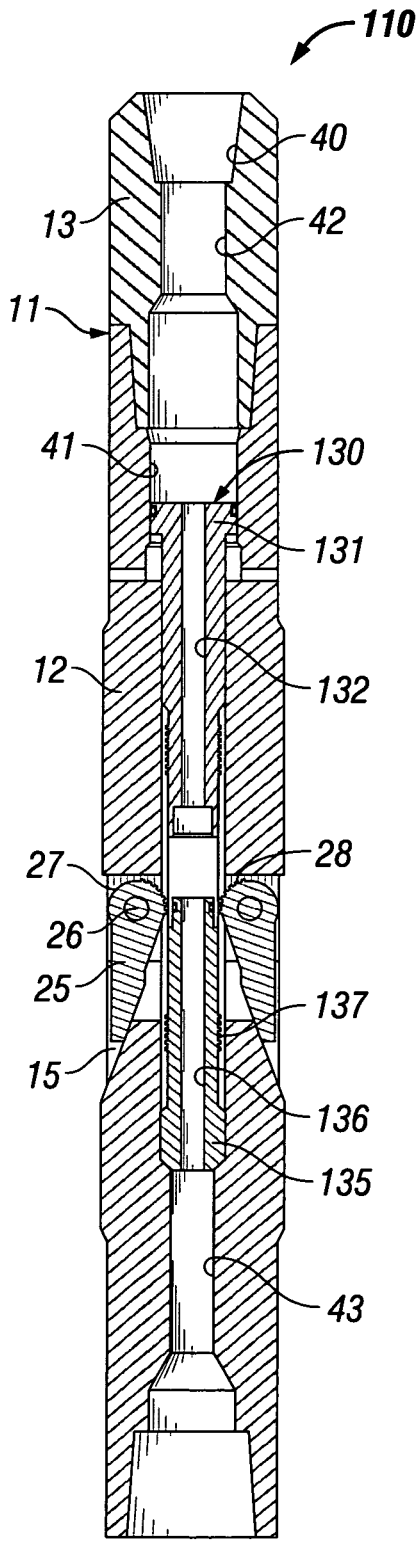

As will be appreciated from FIG. 4A, which shows upper blades 20 nearing full extension, upper piston 31 will continue traveling downward under hydraulic pressure until upper blades 20 are fully extended and have milled away whatever casing is within their sweep. Lower blades 25, as seen in FIG. 4B, remain in their retracted position as upper blades 20 are cutting.

The novel casing cutters preferably provide some indication of when the upper blades have been fully extended. For example, ports 45 are provided in the upper-mid region of cylinder 41 in which upper piston 31 is mounted. Ports 45 allow fluid communication between cylinder 41 and the well annulus surrounding cutter 10. Ports 45 are situated just above a shoulder 46 and in a slightly enlarged portion 47 of cylinder 41. Enlarged upper end of upper piston 31 is shown in FIG. 4A as being slightly above shoulder 46. When upper blades 20 are fully extended, however, the enlarged upper end of upper piston 31 bottoms out on shoulder 46 and fluid is able to flow around the top of upper piston 31, into enlarged portion 47 of cylinder 41, and out into the well annulus through ports 45. That flow will create a pressure drop in fluid being pumped into the work string. That pressure drop may serve as an indicator to operators at the surface that upper blades 20 have been fully extended and have completed cutting of any casing within their cutting diameter.

Other means, however, may be provided for creating a pressure drop when upper piston 31 has bottomed out to fully extend upper blades 20. Ports with seals or valves may be provided in cylinder 41 above piston 31 such that the devices rupture or otherwise release fluid through the ports. Ports could be provided in piston 31 such that they align with ports 45 or extend into window 14 when upper piston 31 bottoms out. Other channels may be devised as well.

When cutting operations have been completed, pumping of fluid is stopped to minimize hydraulic pressure on upper piston 31. Upper blades 20, therefore, are free to retract into windows 14 as shown in FIG. 5. Casing cutter 10 then may be removed from the well by pulling up work string.

It will be appreciated that by providing separate sets of sequentially actuated blades the novel casing cutters are better able to cut through a plurality of nested casings. While cutter blades may be made relatively hard and sharp, as a practical matter, there is a relatively low limit to the extent of milling that may be performed before a set of blades becomes dull or damaged to the extent the further milling is inefficient or impractical. Thus, a prior art cutter with a set of relatively long blades may encompass several casings within its theoretical sweep, but it may not necessarily be able to mill through all of them. The tool would have to be pulled out of the well so that fresh blades could be installed and then run back into the well to finish cutting the remaining casings. The novel cutters, however, allow casings proximate to the tool to be cut with a first set of blades, preferably shorter blades, while casings more removed from the tool are cut with a fresh, preferably longer second set of blades. There is no need to pull the tool out of a well to install fresh blades until both sets of blades have been exhausted.

While actuator 30 in cutter 10 is expected to provide reliable, sequential actuation of lower and upper blades 25 and 20, other actuators may be employed. For example, rack gears 33 and 37 and gear teeth 23 and 28 may be replaced by cooperating cam surfaces. Likewise, it is not essential that the actuators comprise two pistons. A unitary piston may be provided. While hydraulic actuators provide easy, reliable control over the cutter blades, mechanical actuators may also be used. For example, a piston may be provided with pins that engage slots in the cylinder to provide a mechanically indexed actuator. Other actuators also could be devised and used in the various embodiments and aspects of the novel casing cutters.

It also will be appreciated that cutter 10 allows operators to carefully control actuation of the tool. An initial pressure is applied to the tool to actuate lower blades 25. Once lower blades 25 have been fully extended, there will be a drop in hydraulic pressure as fluid is allowed to vent through ports 38. Continued pumping will initiate actuation of upper blades 20, at which time flow though ports 38 will once again be shut off. That allows pressure to be built up more easily to or beyond the initial pressure and transmit greater force to upper blades 20. Once upper blades 20 are fully extended, fluid will vent through ports 46, indicating to the operator that cutting has been completed. Other mechanisms for controlling the actuator and for providing feedback to an operator, however, may be provided.

For example, a second preferred embodiment 110 of the casing cutters of the subject invention is shown in FIGS. 6-9. As may be seen therefrom, casing cutter 110 in most respects shares the same design and operation as novel casing cutter 10. Actuator 130 of casing cutter 110, however, has a somewhat different design for creating a pressure drop when lower blades 25 have been fully extended. That is, as compared to upper piston 31 in cutter 10, skirt 134 of upper piston 131 is much shorter as may be seen best in FIGS. 8C and 8D. Lower piston 135 also does not have any ports similar to ports 38 in lower piston 35. Thus, when lower blades 25 in cutter 110 have been fully extended, and rack gears 37 have traveled past gear teeth 28 on lower blades 25, lower piston 135 will drop out of engagement with upper piston 131. At that point, fluid will flow from conduit 32 in upper piston 31 out windows 14 and 15, thus creating a pressure drop that can be detected by operators at the surface. Continued pumping will actuate upper blades 20. When they have been fully extended, fluid will vent through ports 46 as described above, creating a further pressure drop which indicates to an operator that cutting has been completed.

The casing cutters of the subject invention may be made of materials and by methods commonly employed in the manufacture of oil well tools in general and casing cutters in particular. Typically the cutting blades will be machined from high yield steel, treated with heat or other processes to harden and temper the blades, and provided with tungsten carbide dressing or inserts on the cutting surfaces thereof. Otherwise, the casing cutter body and various components generally will be machined from relatively hard, high yield steel and other ferrous alloys by techniques commonly employed for tools of this type.

Generally speaking, there are two, somewhat loosely defined classes of tubulars: casing and tubing. Casing typically references a larger diameter pipe that is cemented in the well to prevent the hole from slouging in. Tubing generally references a smaller diameter pipe that is suspended inside casing and provides a conduit allowing oil and gas to flow to the surface. Casing typically ranges from 3.5 up to as much as 40 inches in diameter, whereas tubing generally runs from 1.5 to 4.5 inches in diameter.

Since tubing generally may be pulled from a well, the novel cutters more commonly will be used to cut casing, as that term in used in a narrower sense. They may be used, however, to cut a variety of tubular products, if desired, and references to casing shall be understood in that context. It also will be appreciated that the novel casing cutters may be used to cut tubulars in other applications, such as in pipelines, and are not necessarily limited in their application to oil and gas wells.

While this invention has been disclosed and discussed primarily in terms of specific embodiments thereof, it is not intended to be limited thereto. Other modifications and embodiments will be apparent to the worker in the art.

What is claimed is:

1. A tool for cutting casings in oil and gas wells, said cutting tool comprising:

(a) a cylindrical body adapted for connection to a work string and for insertion into a casing mourned in a well, (b) a first set of cutting blades mounted to said body at first pivot points, said first cutting blades being radially offset from each other about said body and being adapted to extend radially from said body about said first pivot points, said extension of said first cutting blades defining a first sweep diameter; and (c) a second set of cutting blades mounted to said body at second pivot points, said second cutting blades being radially offset from each other about said body and being adapted to extend radially from said body about said second pivot points, said extension of said second cutting blades defining a second sweep diameter;

(d) wherein said second sweep diameter is greater than said first sweep diameter and said first pivot points are disposed below said second pivot points at a distance less than the length of a said second cutting blade.

2. The cutting tool of claim 1, wherein said first set of cutting blades and said second set of cutting blades are axially displaced from each other.

3. The cutting tool of claim 1, wherein said first set of cutting blades and said second set of cutting blades are radially displaced from each other.

4. The cutting tool of claim 1, wherein said first cutting blades are mounted for actuation from a retracted, run-in position to an extended, cutting position; and said second set of cutting blades are mounted for actuation from a retracted, run-in position to an extended, cutting position after actuation of said first set of cutting blades.

5. The cutting tool of claim 1, wherein said cutting blades are pivotally mounted in slots defined in said body.

6. The cutting tool of claim 1, wherein said cutting, tool comprises a hydraulic actuator mounted in a cylindrical passageway defined by said body and adapted to extend said first and second sets of cutting blades.

7. The cutting tool of claim 6, wherein said hydraulic actuator comprises an upper piston and a lower piston mounted in said cylinder defined by said body, said upper piston having a cylindrical skirt and wherein an upper portion of said lower piston is nested in said skirt of said upper piston and said lower piston is adapted to travel in said skirt of said upper piston.

8. The cutting tool of claim 7, wherein said upper and lower pistons each have a conduit therein adapted to allow fluids introduced into the tool to flow through said actuator and wherein said actuator comprise a port adapted to allow fluids introduced into said actuator to flow out of said conduit when said lower piston has traveled downward in said skirt of said upper piston.

9. The cutting tool of claim 6, wherein said cutting blades are mounted to said body at their proximate end, said proximate end having gear teeth provided thereon, and said hydraulic actuator comprises a first part and a second part, said first part having a rack gear provided thereon which engages said gear teeth of said first cutting blades and said second part having a rack gear provided thereon which engages said gear teeth of said second cutting blades.

10. The cutting tool of claim 6, wherein said hydraulic actuator comprises a piston mounted in said cylinder defined by said body, travel of said piston in said cylinder adapted to extend said first set of cutting blades from a retracted, run-in position to an extended, cutting position, said piston having a conduit therein adapted to allow fluids introduced into the tool to flow through said piston and a port communicating with said conduit, wherein said port is adapted to allow fluid to flow from said conduit of said piston out of said tool after said piston has fully extended said set of cutting blades.

11. The cuffing tool of claim 6, wherein said hydraulic actuator comprises an upper piston and a lower piston mounted in said cylinder defined by said body, said upper and lower pistons releasably engaging each other and each having a conduit therein adapted to allow fluids introduced into the tool to flow through said actuator, said upper and lower pistons adapted for disengagement after said first set of cutting blades has been fully extended, said disengagement allowing fluid to flow from said conduit of said upper piston out of said tool.

12. The cutting tool of claim 6, wherein said hydraulic actuator comprises a piston mounted in said cylinder defined by said body, travel of said piston in said cylinder adapted to extend said second set of cutting blades from a retracted, run-in position to an extended, cutting position, wherein said cylinder has a port therein and said port is adapted to allow fluid introduced into said cylinder to flow out of said tool after said piston has fully extended said second set of cutting blades.

13. A method of cutting casings in oil and gas wells, wherein said well comprises a plurality of co-extending casings, said method comprising:

(a) inserting a cutting tool into the innermost of said co-extending casings, said cutting tool comprising;

i) a cylindrical body;

ii) a first set of cutting blades mounted to said body at first pivot points, said first cutting blades being mounted for actuation from a retracted, run-in position to an extended, cutting position, said first cutting blades defining a first sweep diameter in said extended, cutting position; and iii) a second set of cutting blades mounted to said body at second pivot points, said second cutting blades being mounted for actuation from a retracted, run-in position to an extended, cutting position, said second cutting blades defining a second sweep diameter in said extended, cutting position;

iv) said second sweep diameter being greater than said first sweep diameter and said first pivot points being disposed below said second pivot points at a distance less than the length of a said second cutting blade;

(b) rotating said cylindrical body and actuating said first set of cutting blades to cut said co-extending casings within said first sweep diameter; and (c) rotating said cylindrical body and actuating said second set of cutting blades to cut said co-extending casings beyond said first sweep diameter and within said second sweep diameter.

14. The method of claim 13, wherein said first set of cutting blades and said second set of cutting blades are axially displaced from each other.

15. The method of claim 13, wherein said first set of cutting blades and said second set of cutting blades are radially displaced from each other.

16. The method of claim 13, wherein said cutting tool comprises a hydraulic actuator mounted in a cylindrical passageway defined by said body and adapted to extend said first and second sets of cutting blades.

17. The method of claim 16, wherein said hydraulic actuator comprises an upper piston and a lower piston mounted in said cylinder defined by said body, said upper piston having a cylindrical skirt and wherein an upper portion of said lower piston is nested in said skirt of said upper piston and said lower piston is adapted to travel in said skirt of said upper piston.

18. The method of claim 17, wherein said upper and lower pistons each have a conduit therein adapted to allow fluids introduced into the tool to flow through said actuator and wherein said actuator comprise a port adapted to allow fluids introduced into said actuator to flow out of said conduit when said lower piston has traveled downward in said skirt of said upper piston.

19. The method of claim 16, wherein said cutting, blades are mounted to said body at their proximate end, said proximate end having gear teeth provided thereon, and said hydraulic actuator comprises a first part and a second part, said first part having a rack gear provided thereon which engages said gear teeth of said first cutting blades and said second part having a rack gear provided, thereon which engages said gear teeth of said second cutting blades.

20. A tool for cutting casings in oil and gas wells, said cutting tool comprising:

(a) a cylindrical body adapted for connection to a work string and for insertion into a casing mounted in a well, (b) a first set of cutting blades mounted to said body, said first cutting blades being radially offset from each other about said body and being adapted to extend radially from said body, said extension of said first cutting blades defining a first sweep diameter;

(c) a second set of cutting blades mounted to said body, said second cutting blades being radially offset from each other about said body and being adapted to extend radially from said body, said extension of said second cutting blades defining, a second sweep diameter; and (d) a hydraulic actuator mounted in a cylindrical passageway defined by said body and adapted to extend said first and second sets of cutting blades;

(e) Wherein said hydraulic actuator comprises an upper piston and a lower piston mounted in said cylinder defined by said body, said upper piston having a cylindrical skirt and wherein an upper portion of said lower piston is nested in said skirt of said upper piston and said lower piston is adapted to travel in said skirt of said upper piston.

21. The cutting tool of claim 20, wherein said upper and lower pistons each have a conduit therein adapted to allow fluids introduced into the tool to flow through said actuator and wherein said actuator comprise a port adapted to allow fluids introduced into said actuator to flow out of said conduit when said lower piston has traveled downward in said skirt of said upper piston.

22. A tool for cutting casings in oil and gas wells, said cutting tool comprising:

(a) a cylindrical body adapted for connection to a work string and for insertion into a casing mounted in a well, (b) a first set of cutting blades mounted to said body, said first cutting blades being radially offset from each other about said body and being adapted to extend radially from said body, said extension of said first cutting blades defining a first sweep diameter;

(c) a second set of cutting blades mounted to said body, said second cutting blades being radially offset from each other about said body and being adapted to extend radially from said body, said extension of said second cutting blades defining a second sweep diameter; and (d) a hydraulic actuator mounted in a cylindrical passageway defined by said body and adapted to extend said first and second sets of cutting blades;

(e) wherein said cutting blades are mounted to said body at their proximate end, said proximate end having gear teeth provided thereon, and said hydraulic actuator comprises a first part and a second part, said first part having a rack gear provided thereon which engages said gear teeth of said first cutting blades and said second part having a rack gear provided thereon which engages said gear teeth of said second cutting blades.

23. A tool for cutting casings in oil and gas wells, said cutting tool comprising:

(a) a cylindrical body adapted for connection to a work string and for insertion into a casing mounted in a well, (b) a first set of cutting blades mounted to said body, said first cutting blades being radially offset from each other about said body and being adapted to extend radially from said body; said extension of said first cutting blades defining a first sweep diameter;

(c) a second set of cutting blades mounted to said body, said second cutting blades being radially offset from each other about said body and being adapted to extend radially from said body, said extension of said second cutting blades defining a second sweep diameter; and (d) a hydraulic actuator mounted in a cylindrical passageway defined by said body and adapted to extend said first and second sets of cutting blades;

(e) wherein said hydraulic actuator comprises a piston mounted in said cylinder defined by said body, travel of said piston in said cylinder adapted to extend said first set of cutting blades from a retracted, run-in position to an extended, cutting position, said piston having a conduit therein adapted to allow fluids introduced into the tool to flow through said piston and a port communicating with said conduit, wherein said port is adapted to allow fluid to flow from said conduit of said piston out of said tool after said piston has fully extended said set of cutting blades.

24. A tool for cutting casings in oil and gas wells, said cutting tool comprising:

(a) a cylindrical body adapted for connection to a work string and for insertion into a casing mounted in a well, (b) a first set of cutting, blades mounted to said body, said first cutting blades being radially offset from each other about said body and being adapted to extend radially from said body, said extension of said first cutting blades defining a first sweep diameter;

(c) a second set of cutting blades mounted to said body, said second cutting blades being radially offset from each other about said body and being adapted to extend radially from said body, said extension of said second cutting blades defining a second sweep diameter; and (f) a hydraulic actuator mounted in a cylindrical passageway defined by said body and adapted to extend said first and second sets of cutting blades;

(g) wherein said hydraulic actuator comprises an upper piston and a lower piston mounted in said cylinder defined by said body, said upper and lower pistons releasably engaging, each other and each having a conduit therein adapted to allow fluids introduced into the tool to flow through said actuator, said upper and lower pistons adapted for disengagement after said first set of cutting blades has been fully extended, said disengagement allowing fluid to flow from said conduit of said upper piston out of said tool.

25. A tool for cutting casings in oil and gas wells, said cutting tool comprising:

(a) a cylindrical body adapted for connection to a work string and for insertion into a casing mounted in a well, (b) a first set of cutting blades mounted to said body, said first cutting blades being radially offset from each other about said body and being adapted to extend radially from said body, said extension of said first cutting blades defining a first sweep diameter;

(c) a second set of cutting blades mounted to said body, said second cutting blades being radially offset from each other about said body and being adapted to extend radially from said body, said extension of said second cutting blades defining a second sweep diameter; and (h) a hydraulic actuator mounted in a cylindrical passageway defined by said body and adapted to extend said first and second sets of cutting, blades;

(i) wherein said hydraulic actuator comprises a piston mounted in said cylinder defined by said body, travel of said piston in said cylinder adapted to extend said second set of cutting blades from a retracted, run-in position to an extended, cutting position, wherein said cylinder has a port therein and said port is adapted to allow fluid introduced into said cylinder to flow out of said tool after said piston has fully extended said second set of cutting, blades.

* * * * *

UNITED STATES PATENT AND TRADEMARK OFFICE

CERTIFICATE OF CORRECTION

PATENT NO. : 8,839,864 B2
APPLICATION NO. : 13/694208
DATED : September 23, 2014
INVENTOR(S) : Douglas T. Beynon It is certified that error appears in the above-identified patent and that said Letters Patent is hereby corrected as shown below:

In the Claims,

In column 11, line 22 (claim 1), delete “mourned” and insert therein -- mounted --.

In column 12, line 23 (claim 11), delete “cuffing” and insert therein -- cutting --.

In column 13, line 35 (claim 19), delete “,”.

In column 13, line 54 (claim 20), delete “Wherein” and insert therein -- wherein --.

In column 15, line 7 (claim 24), delete “,”.

Signed and Sealed this
Ninth Day of December, 2014

Michelle K. Lee

Michelle K. Lee
*Deputy Director of the United States Patent and Trademark Office*